United States Patent [19]

Molins et al.

[11] 3,999,655

[45] Dec. 28, 1976

[54] PACKETS FOR SMOKING ARTICLES

[75] Inventors: Desmond Walter Molins; Robert William Davies, both of London, England

[73] Assignee: Molins Limited, London, England

[22] Filed: Jan. 28, 1975

[21] Appl. No.: 544,999

[30] Foreign Application Priority Data

Jan. 28, 1974 United Kingdom ..... 3145/74

[52] U.S. Cl. ..... 206/259; 206/264; 206/498; 229/51 C

[51] Int. Cl.[2] ..... B65D 85/10; B65D 17/20; B65D 65/36

[58] Field of Search ..... 206/259, 269, 264, 273, 206/274, 271, 245, 275, 498; 229/51 C, 51 S, 51 TS, 51 MS, 87 C, 55, 66

[56] References Cited

UNITED STATES PATENTS

| | | | |
|---|---|---|---|
| 1,864,873 | 6/1932 | Straus | 206/259 |
| 1,884,545 | 10/1932 | Boutin | 229/51 C |
| 1,914,005 | 6/1933 | Brown | 206/259 |
| 2,071,927 | 2/1937 | Geerlings | 229/51 C |
| 2,112,013 | 3/1938 | Chalmers | 229/51 C |
| 2,152,398 | 3/1939 | Chalmers | 229/87 C |
| 2,240,539 | 5/1941 | Baldwin | 229/51 C |
| 2,305,428 | 12/1942 | Johnson | 229/51 C |
| 2,321,112 | 6/1943 | Tamarin | 229/51 C |
| 2,805,018 | 9/1957 | Aiken | 229/51 C |
| 2,904,169 | 9/1959 | Keating | 206/273 |
| 3,118,588 | 1/1964 | Noble | 229/14 BA |

*Primary Examiner*—William T. Dixson, Jr.
*Assistant Examiner*—Allan N. Shoap
*Attorney, Agent, or Firm*—John C. Smith, Jr.

[57] ABSTRACT

In a soft packet, particularly for filter-tipped cigarettes, the narrow sides are reinforced by panels, which may be joined together at the bottom to form a U-shaped frame. The longitudinal edges of the panels may be curved, or bent perpendicularly inwards. Various moisture-proof wrappers are disclosed for directly holding the panels about the cigarettes, some incorporating tear guiding strips to assist opening of the top of the packet.

9 Claims, 7 Drawing Figures

PACKETS FOR SMOKING ARTICLES

This invention concerns improvements in or relating to packets for smoking articles, in particular for cigarettes.

In a conventional soft packet the cigarettes are normally contained in three distinct layers: firstly an inner foil wrapper, which provides some degree of moisture protection for the cigarettes; secondly a paper cup on which the indicia of the cigarette brand and other decorative matter are printed; and lastly an outer moisture-resistant wrapper, usually of cellulose film.

Proposals have been made to simplify the construction of such packets, but these have often resulted in the desired strength of the packet being impaired.

According to the present invention there is provided a packet for smoking articles, the packet having a top, a bottom, two large faces and two narrow sides, and comprising an outer wrapper made from a substantially rectangular blank of thin moisture-proof material, tear means to allow at least part of the top to be opened, and an internal reinforcing panel held in position against each side, each panel having an end positioned at or near the top of the respective side.

The tear means may comprise a tear tab on the top, and a tear guide strip secured to at least one of the large faces of the wrapper immediately below the part of the top to be opened.

The wrapper may be folded about the sides and the large faces, and may be longitudinally sealed to form a tube whose ends form margins extending over the top and the bottom, at least one end of the tube being closed by a fishtail closure. By this expression "fishtail closure" as used herein, is to be understood that the margins from the large faces are sealed together with their inner surfaces contiguous, thereby forming a sealed margin of double thickness, and that the sealed margin and the resulting triangulated portions at the ends thereof are folded down.

The invention also extends to a method of forming a tearable opening in the top of a packet made from a thin moisture-proof wrapper, comprising the steps of folding and sealing the wrapper about the narrow sides and large faces of the packet to leave a margin around the top, forming a tear line below the margin, securing a tear guide strip over the tear line, and forming a closure at the top of the packet.

Further according to the invention there is provided a composite blank for forming into a packet for smoking articles, comprising a substantially rectangular sheet of thin moisture-proof material and a pair of relatively long internal reinforcing panels adhesively secured to the rectangular sheet at positions such that they extend along the narrow sides of the resultant packet.

Four examples of cigarette packets according to the invention will now be described with reference to the accompanying drawings, in which each figure is shown in perspective view.

Figure 1:
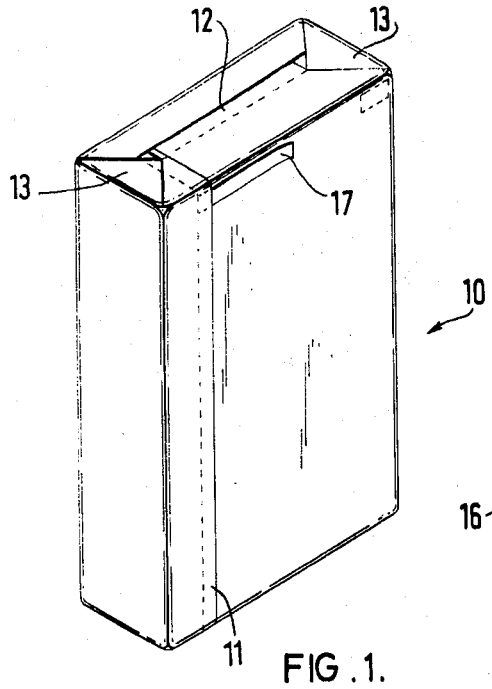
FIG. 1 is a view of a first packet.

The first cigarette packet shown in FIG. 1 consists essentially of a rectangular tube 10 made of polypropylene and having a longitudinal seam 11.

The top and bottom ends of the packet are each sealed by a fishtail closure, as herein defined. With regard to the top of the packet, for example, the end of the tube is first sealed flat up to the top of the cigarettes along a margin 12 (giving the appearance of a "fishtail") and the margin 12 and the resulting triangulated portions 13 are then in turn folded flat against the top of the cigarettes.

Figure 2:
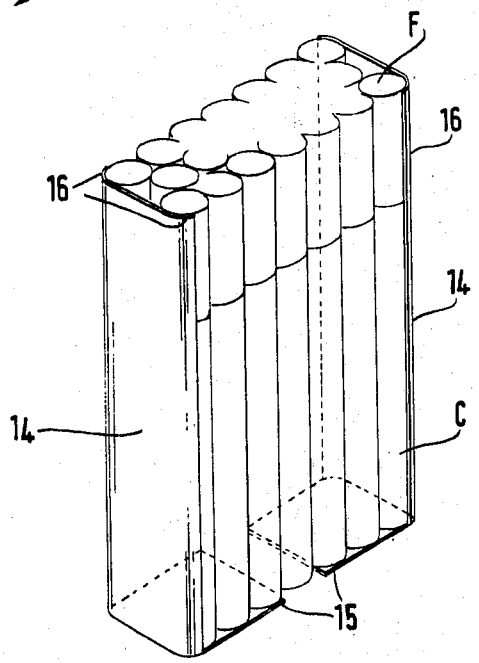
FIG. 2 is a view of the internal construction of the first packet.

Referring now to FIG. 2, in which the tube has been omitted for the sake of clarity, the filtertipped cigarettes C contained in the packet are laterally supported at each narrow side of the packet by a reinforcing panel 14 made of card. The panels 14 extend the full length of the cigarettes, and are glued to the inside surface of the tube. Hinged to the bottom of each panel is a flap 15 which protects the tobacco ends of all the cigarettes apart from those at the middle of the large faces, which are less likely to be damaged. The filter tips F uppermost in the packet do not require such protection.

The longitudinal margins 16 of the panels 14 are curved around the corners of the packet, the curvature corresponding to the radius of the cigarettes.

The polypropylene blank from which the tube is made is internally printed to show the brand of the cigarettes and any other decorative matter which may be required. In this way the tube may be made to appear opaque, if it is so desired not to see the cigarettes through the packet.

A tear guide strip 17 is provided around part of the circumference of the top of the packet. The tear guide strip is secured along the inside surface of the tube 10, passing at the narrow sides of the tube between the panels 14 and the tube. From the level at the bottom edge of the tear guide strip to the top of the panels no glue is applied between the panels and the tube, in order that removal of the tear guide strip is not hindered when the packet is torn open.

The manner of forming the packet will now be briefly described.

The longitudinal margins 16 of the reinforcing panels 14 are formed to the radius of the cigarettes by being passed through a suitable mandrel or by being pressed between appropriately shaped dies. The panels are then glued to the printed polypropylene blank up to the level at which the tear guide strip is secured to it (as indicated above), thus forming a composite blank. The blank is now formed around a bundle, of say, 20 cigarettes and longitudinally sealed along a seam 11. The flaps 15, which are not glued to the inner surface of the blank, are then folded inwards against the tobacco ends of the cigarettes, and finally the fishtail closures formed at the ends of the tubes, as previously described.

It will be appreciated that the provision of a composite blank, that is the securing of the panels to the polypropylene blank, greatly facilitates the packing operation and hence simplifies the machinery for packing the cigarettes. Furthermore the securing of the panels to the tube ensures that in use the packet will have its sides reinforced even while it is being progressively emptied.

It may be found that the fishtail closures at the ends of the packet are sufficiently strong to prevent damage to the ends of the cigarettes. In this event the flaps 15 may be omitted.

Figure 3:
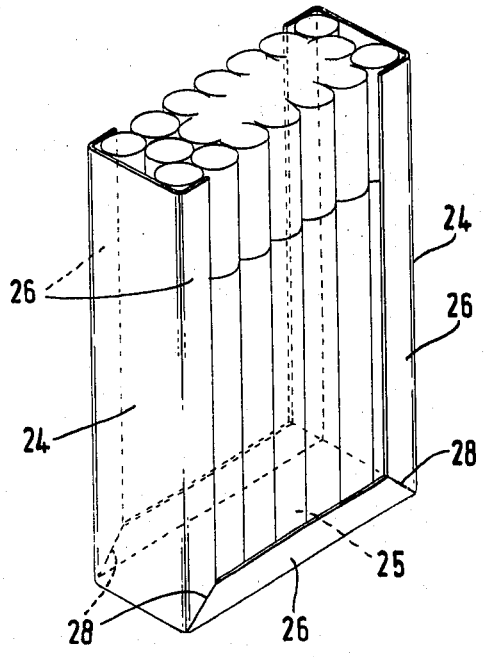
FIG. 3 is a modification of the internal construction of FIG. 2.

In the modification of the first packet shown in FIG. 3, only the internal construction of the packet is different from that described, so that its final outer appearance would be the same as shown in FIG. 1. The reinforcing panels 24 are here made from a single card blank, the panels being joined together by a base portion 25 to form when erect a U-shaped frame. The edges of the frame, instead of being curved as above, are all bent at right angles to form comparatively long extensions 26 into the large faces of the packet. The junctions 28 between the extensions are mitred at an angle of 45° to provide abutments against one another.

In this construction of the packet the U-frame is formed around the bundle of cigarettes before the tube is glued to the panels, as it is here not feasible to provide a composite blank. In fact due to the springiness of the U-frame the panels may remain in position against the sides of the tube without being glued thereto.

Turning now to packets shown in FIGS. 4 to 7, each of these packets consists essentially of two parts: an outer wrapper made from a rectangular blank of polypropylene film, which is again internally printed to show the cigarette brand, etc.; and an inner reinforcing strip.

Figure 4:
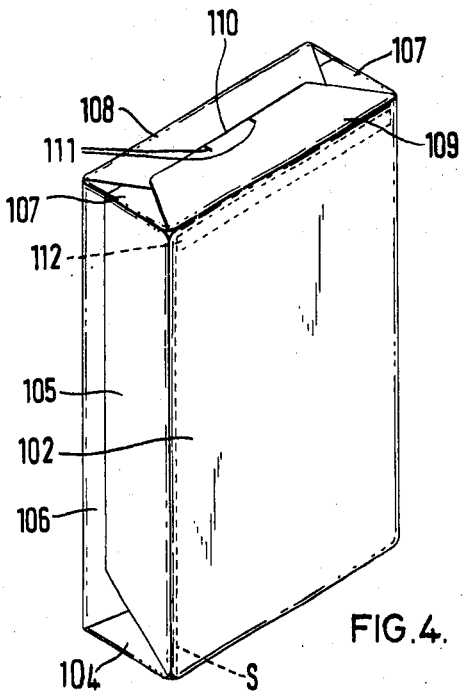
FIG. 4 is a view of a second packet.
Figure 5:
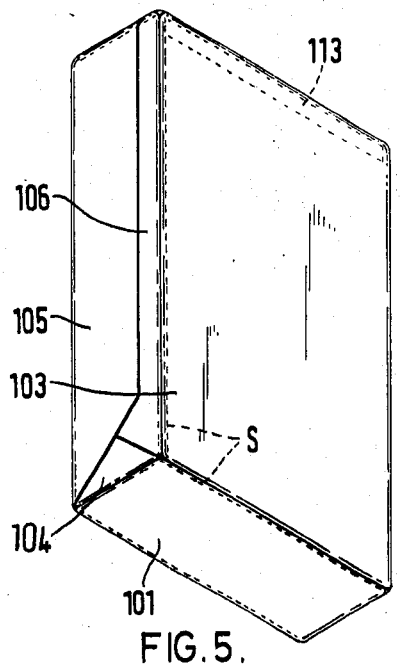
FIG. 5 is a view of the packet of FIG. 4 as viewed in the opposite direction.

Considering first FIGS. 4 and 5, the separate parts of this second packet will be described with reference to the manner in which the packet is made. The wrapper blank is formed around the end of a bundle of cigarettes so as to lie against the large faces of the bundle, thus forming respectively a base 101, a front face 102, and a back 103. The dimensions of the blank are such that margins of a width greater than half the depth of the bundle are formed at the top and sides of the bundle.

Each portion 104 of the margin which extends from the side of the base 101 is now tucked in towards the narrow side of the bundle, so that the bottom ends of the side margins 105 and 104 are triangulated. The side margins 106 for the back face 103 are next folded on to the sies of the bundle, and the side margins 105 from the front face are likewise folded to overlap the margin 106.

The top of the packet is closed by forming tucks at the tops 107 of the side margins 105 and 106 and in turn folding over the top margins 108 and 109 which extend respectively from the back and front faces, and adhesively securing the margins together at the overlap.

The base and sides of the packet are internally reinforced by a U-shaped reinforcing frames comprised of panels (shown dotted) made of a laminate of paper and aluminum foil, the foil facing outwards. The width of the frame at the base corresponds to the depth of the bundle. The frame S is slightly wider at the sides, the edges being curved to the radius of the cigarettes. This curving is similar to that of the longitudinal margins 16 of the reinforcing panels 14 of the first packet, shown in FIG. 2.

The base and sides of the reinforcing frames are adhesively secured to the inside surfaces of the wrapper, and the side margins 105 and 106, as well as the top margins 108 and 109, are then adhesively secured together so as to seal the packet completely.

Opening of the packet is effected by a tear tab 110 provided in the top margin 109 by a pair of slits 111 formed in the wrapper blank. By pulling the tab 110, to which no adhesive is applied, towards the front face 102, the top of the packet can be torn open. A tear guide strip 112 is secured to the inside of the wrapper along the top of the front face 102 to prevent the tear passing down the front face. A similar tear guide strip 113 is secured inside the top of the rear face 103. Tearing of the wrapper down the sides is prevented by the reinforcing frame S which extends up to the top of the packet, the tear guide strips 112 and 113 and the upper edges of the panels of the reinforcing frame S being in substantially the same plane at the top of the front, rear and side faces of the packet.

The strip 112 could, alternatively, be secured to the outside of the wrapper.

Securing of the reinforcing frame S to the wrapper, and sealing of the wrapper together, may be effected as follows. The outside surfaces of the reinforcing frame S are coated with a layer of hot melt adhesive, and a composite wrapper blank is formed by securing the reinforcing frame S across the middle of the wrapper, i.e. along the base 101 and on to the portions 104, by the application of heat. The areas of the wrapper which are to be secured together, in particular the areas beneath the margins 105, 106, 108 and 109, are also coated with a layer of hot melt adhesive before the wrapper is formed. When the packet is erected, heat is applied to the sides and top of the packet to adhesively secure the remainder of sides of the reinforcing frame S to the inside surfaces of the wrapper, and also to secure the side and top margins together.

Instead of having hot melt adhesive at selected areas, the entire wrapper may be coated with a heat sealing material such as cellulose.

Figure 6:
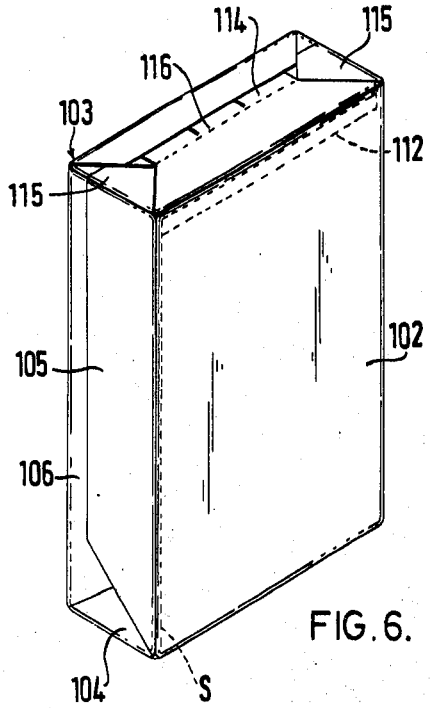
FIG. 6 is a view of a third packet.
Figure 7:
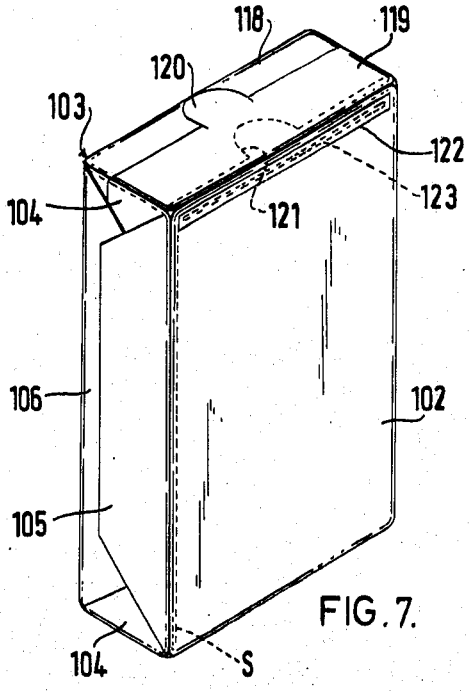
FIG. 7 is a view of a fourth packet.

The third packet shown in FIG. 6 is similar to the second, differing only in the manner in which the top of the packet is formed. When the side margins 105 and 106 have been folded and secured, the margins at the top are formed into a fishtail closure: the margins are sealed together to form a seam 114 which is then folded over against the top, the resulting triangulated side portions 115 then being also folded over against the top. A tear tab 116 is formed in the seam 114, and again no adhesive is applied to the area beneath it. The seam 114 will, however, be made wider than shown in FIG. 6, to ensure sufficient sealing beneath the tab 116.

In the fourth packet, shown in FIG. 7, the top closure is again different. In this case the top is formed by folding over on to the top the margin 118 which extends from the back face 103, then similarly folding over the margin 119 from the front face 102, and adhesively securing the two margins together. The sides of the packet are finally formed in the same manner as for the second packet, except that tucks are made at the top portions 104 as well as at the bottom.

The tear tab 120 in the margin 119 of the fourth packet, is longer than that in the second packet. To avoid wastage of material in producing a blank for this packet, the tab 120 of one blank is formed from the material at the end of the next blank. Thus in the top margin 118 there is a cut out 121 which corresponds to the shape of the tab 120.

A tear guide strip 122 is also provided at the top of the front and back faces 102 and 103. In this fourth packet, however, each strip 122 is secured over a tear line 123 in the wrapper to give added protection against the tear passing down the respective face. Thus, the tear lines 123, tear guide strips 122 and upper edges of the panels of the reinforcing frame S which are adhesively secured to the inside surface of the wrapper are all in substantially the same plane at the top of the front, back and side faces of the packet.

The tear line 123 is preferably cut just prior to the forming of the top closure, and the tear guide strip 122 then secured over it. In this way propagation of the tear lines 123 by subsequent operations is avoided.

It will be appreciated that the cigarettes, if filter-tipped, are oriented in each of the packets of FIGS. 4 to 7 with their tobacco portions facing the reinforced base, the mouthpiece portions of the cigarettes (which are not so vulnerable) being at the nonreinforced top of the packet, as in the first packet.

Referring again to FIGS. 1 to 3, the first packet need not have fishtail closures both at the top and at the bottom. Thus the bottom of that packet may be formed by tucked and folded margins similar to the top closure shown in FIG. 4.

The material of the wrappers for all the packets may be other than polypropylene. For example, wrappers made from films of polyester or cellulose are also considered suitable. The moisture proof properties of these films may be improved by the application of a thin coating of polyvinyldichloride.

The thickness of the wrapper film may be about 0.001 in. But if it is desired to have a stiffer packet, a laminated film of about 0.0024 in. thickness may be used. For example, a laminate of polyethylene and polyester, or polyethylene and cellulose is considered suitable. In this case the polyethylene is believed to be beneficial in improving the moistureproof properties of the final packet, in providing a heat seal for the film and also in improving the handling properties of the film in the machines on which the packets are made.

We claim:

1. A packet for smoking articles, comprising a single wrapper made from a substantially rectangular blank of thin moisture-proof material and folded to form a top, a bottom, two large faces and two narrow sides of said packet, a reinforcing panel at the inside of each narrow side, each panel having an upper edge positioned substantially at the top of the respective side and being secured to the interior surface of said wrapper at said respective side at least in the region of said upper edge, a tear line formed in each of said large faces of said wrapper and a tear guide strip secured over each of said tear lines along the top of said faces with its ends adjoining said upper edges of the reinforcing panels whereby said upper edges of said reinforcing panels, said tear lines and said tear guide strips are in substantially the same plane, and a tear tab formed on the top of the wrapper, whereby the top of the packet may be opened by pulling the tear tab to tear the top of the wrapper free along said tear lines and along said upper edges of said reinforcing panels.

2. A packet according to claim 1 further comprising flaps extending from the bottom ends of said reinforcing panels at least partly towards one another to reinforce the bottom of said packet.

3. A packet according to claim 1 in which said panels include longitudinal margins which extend at least partly around the respective corners between the sides and large faces.

4. A packet according to claim 3 in which the extended width of the panels is greater than the overall width of the sides of the packet, the longitudinal margins being bent around the corners to the sectional profile of the smoking articles.

5. A packet according to claim 1 in which the wrapper is made from a transparent film, and in which the inside surface of the wrapper is imprinted with the desired indicia of the packet.

6. A packet according to claim 1 in which the material of the transparent film is selected from the group consisting of cellulose, polypropylene and polyester.

7. A packet according to claim 6 in which the transparent film is laminated with polyethylene.

8. A packet according to claim 1 in which the reinforcing panels are made from a laminate of paper and aluminum foil, the foil being adjacent the wrapper.

9. A method of forming a packet for smoking articles, said packet including a wrapper made from a substantially rectangular blank of thin moisture-proof material and two reinforcing panels each having an upper edge, comprising the steps of folding the wrapper to form a bottom, two large faces and two narrow sides with a marginal portion of the wrapper projecting upwardly for subsequent folding into a top, each of said narrow sides extending over one of said reinforcing panels with said upper edge thereof positioned substantially at the top of said narrow side, securing the interior surface of each of said narrow sides to the respective reinforcing panel at least in the region of said upper edge thereof, cutting a tear line in each of said large faces between said upper edges of said reinforcing panels, securing a tear guide strip over each of said tear lines with its ends adjoining said upper edges of said reinforcing panels, said tear lines, said tear guide strips and the upper edges of said reinforcing panels being in substantially the same plane, and folding said marginal portion of said wrapper to form said top.

* * * * *

UNITED STATES PATENT AND TRADEMARK OFFICE

CERTIFICATE OF CORRECTION

PATENT NO. : 3,999,655

DATED : December 28, 1976

INVENTOR(S) : Desmond Walter Molins and Robert William Davies

It is certified that error appears in the above-identified patent and that said Letters Patent are hereby corrected as shown below:

On the cover page, in the first column, the "Foreign Application Priority Data" should read:

| | | |
|---|---|---|
| Jan. 28, 1974 | United Kingdom ..... | 3945/74 |
| Oct. 18, 1974 | United Kingdom ..... | 45315/74 |

Signed and Sealed this

Seventeenth Day of May 1977

[SEAL]

*Attest:*

RUTH C. MASON
*Attesting Officer*

C. MARSHALL DANN
*Commissioner of Patents and Trademarks*